US006591730B2

(12) United States Patent
Beal

(10) Patent No.: US 6,591,730 B2
(45) **Date of Patent: *Jul. 15, 2003**

(54) CAP FOR A MULTI-COMPONENT AMMUNITION PROJECTILE AND METHOD

(75) Inventor: Harold F. Beal, Rockford, TN (US)

(73) Assignee: Doris Nebel Beal Intervivos Patent Trust, Pawleys Island, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/145,936

(22) Filed: May 15, 2002

(65) Prior Publication Data

US 2002/0170416 A1 Nov. 21, 2002

Related U.S. Application Data

(60) Provisional application No. 60/291,173, filed on May 15, 2001.

(51) Int. Cl.[7] ..... F42B 33/00

(52) U.S. Cl. ..... 86/55; 102/506; 102/507; 102/516; 102/517

(58) Field of Search ..... 86/54, 55; 102/501, 102/506–510, 514–519

(56) References Cited

U.S. PATENT DOCUMENTS 2,393,648 A * 1/1946 Martin ..... 102/517
5,454,325 A * 10/1995 LeBlanc ..... 102/516
5,834,683 A * 11/1998 Benvegnu ..... 102/516
5,847,313 A * 12/1998 Beal ..... 102/516
6,317,946 B1 * 11/2001 Beal ..... 102/516
6,371,029 B1 * 4/2002 Beal ..... 102/516

* cited by examiner

*Primary Examiner*—Harold J. Tudor
(74) *Attorney, Agent, or Firm*—Pitts & Brittian, P.C.

(57) ABSTRACT

Method of manufacture of a multi-component projectile 14 for gun ammunition 16 including the steps of providing a uniformly spherical ball 18 of a ductile metal, either solid metal or a self-supporting pressed compact of metal powder particles, inserting the metal ball into the open end 10 of a cup-shaped jacket 54 which houses at least one core 30, the ball being disposed between that end of the core adjacent the open end of the jacket and the open end of the jacket. Axially directed pressure against the ball deforms the ball into a generally flat disc 36. Simultaneously, the core 30 may be seated within the closed end 26 of the jacket. Thereafter, the jacket/core/disc combination is die-formed to define an ogive 42 at the open end of the jacket. This action, among other things, deforms that end of the core adjacent the ogive, the disc and the open end of the jacket into the desired ogive geometry, the disc being deformed into a cap 70 of generally hollow hemispherical geometry and containing powder particles 50 from the core within the hollow of the cap.

9 Claims, 5 Drawing Sheets

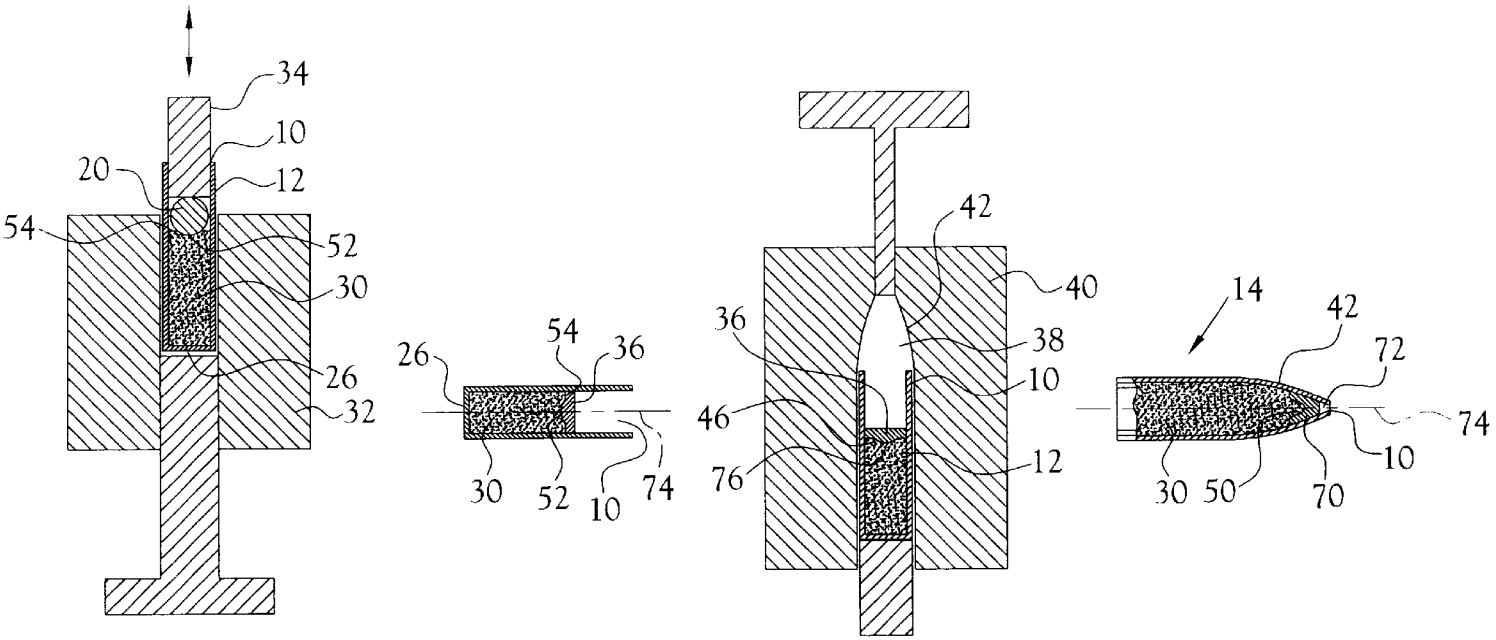
Fig.4
Fig.5
Fig.6
Fig.7
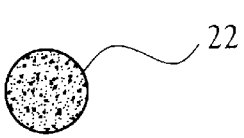
Fig.9
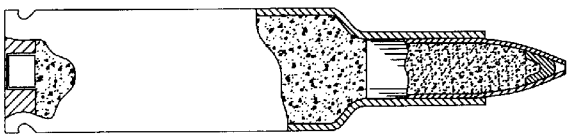
Fig.8

CAP FOR A MULTI-COMPONENT AMMUNITION PROJECTILE AND METHOD

RELATED INVENTIONS

The present application is a non-provisional application based on Provisional Application Ser. No. 60/291,173, filed May 15, 2001, entitled: METHOD FOR THE MANUFACTURE OF A SOLID CAP FOR A MULTI-COMPONENT AMMUNITION PROJECTILE AND PRODUCT.

FIELD OF INVENTION

This invention relates to gun ammunition, and specifically to gun ammunition in which a round of the ammunition includes a casing which houses gunpowder and a projectile. More specifically, the present invention relates to multi-component gun ammunition projectiles having one or more powder-based cores disposed within a cup-shaped jacket having an open end and a seal (cap) for the open end of the jacket.

BACKGROUND OF INVENTION

Of relatively recent vintage is a gun ammunition projectile which is fabricated from two or more metal powders. Commonly, the metal powders are die-pressed into a cylindrical geometry. Such pressed compacts are at times referred to as "cores". To form a projectile, at least one core is placed in a hollow cup-shaped metal jacket having one end thereof closed and its opposite end open for the receipt of the core. After the core has been placed in the jacket, a disc is introduced into the jacket. Employing axially directed pressure applied to the disc, the core(s) is seated against the closed end of jacket and the disc is deformed to form a seal diameterally of the jacket sufficient to prevent the escape of powder particles from the core during subsequent manufacturing operations. The open end of the jacket, that end of the core adjacent the open end of the jacket, and the disc are thereafter die-formed to define an ogive on the leading end of the jacket. The formation of the ogive tends to partially crush that portion of the core which is involved in the formation of the ogive, generating unbonded metal powder particulates adjacent the leading end of the projectile. In those projectiles where the ogive end of the projectile is not fully closed, this unbonded powder is free to escape from the projectile during handling of a round of ammunition which includes the projectile, while the round is in a gun, or after the round has been fired. Also loose powder particulates within the jacket of the projectile also may be spun to one side of the jacket, causing nutation of the spinning projectile as the projectile is traveling to a target.

In U.S. Pat. No. 5,789,698, the present inventor disclosed the use of a solid metal disc, initially formed externally of the jacket of the projectile as a disc of uniform thickness and density, to be placed within the jacket adjacent the exposed end of the core prior to formation of the ogive. As the ogive is formed, this disc is also deformed and urged toward the open end of the jacket where it remains to seal the open end of the deformed jacket and prevent the escape of metal powder from the ogive end of the projectile.

Whereas these solid metal discs are effective for their intended purpose, their cost of manufacture and/or other factors have raised the need for a different type disc. One such disc conceived by the present inventor is disclosed in copending U.S. patent application Ser. No. 09/491,257, filed Jan. 26, 2000, entitled: Powder-based Disc for Gun Ammunition Having a Projectile Which Includes a Frangible Powder-based Core Disposed Within a Metallic Jacket. The disc of this copending application comprises a metal powder, particularly a tin metal powder, which is die formed into a disc of a preselected diameter, and which is of uniform cross-sectional thickness, is uniform in density throughout the disc, and which is deformable when deployed in a projectile jacket with a core, and the open (leading) end of the combination is die-formed to define an ogive on the leading end of the multi-component projectile.

A further powder-based disc is disclosed by the present inventor in a U.S. Provisional patent application filed Apr. 30, 2001, entitled: Method of Manufacture of a Powder-based Cap for a Gun Ammunition Projectile. In this latter cap, a powdered metal is die-formed into a disc, heat treated to about its liquification temperature, and quenched to provide at least a disc having a central core of metal powder particulates encased in a skin formed by the melding of adjacent metal powder particles as the headed disc is quenched.

SUMMARY OF INVENTION

The present invention provides a method of manufacture of a multi-component projectile for gun ammunition, particularly ammunition for guns of 50 caliber or smaller caliber's, such as the military 5.56 mm round, among others. The method includes the steps of providing a uniformly spherical ball of a ductile metal, either solid metal or a self-supporting pressed compact of metal powder particles, inserting the metal ball into the open end of a cup-shaped jacket which houses at least one core. The ball is disposed between that end of the core adjacent the open end of the jacket and the open end of the jacket. Thereafter, through the application of axially directed pressure against the ball, the ball is deformed into a generally flat disc. Simultaneously, the core may be seated within the closed end of the jacket. Thereafter, the jacket/core/disc combination is placed in a die suitable for the formation of an ogive on the open end of the jacket and axially directed pressure applied to the closed end of the jacket is employed to force the open end of the jacket (with the disc and a portion of the core) into the ogive-defining die cavity. This action deforms that end of the core adjacent the ogive, the disc and the open end of the jacket into the desired ogive geometry, the disc being deformed into a cap of generally hollow hemispherical geometry and containing powder particles from the core within the hollow of the cap.

The ball of the present invention may be formed as a solid metal ball or may be formed by compressing a quantity of metal powder particles into a spherical geometry having uniform density throughout the pressed compact. The advantages of the present invention include the ability to prepare, externally of the jacket, a member of very precise diametral dimension, uniform density throughout, and having the desired ductility property, at a low cost of manufacture, and which is readily fed into a jacket atop a core disposed within the jacket, by mechanical means. Moreover, the spherical geometry of the ball provides for accurate placement of the ball with its diameter aligned with the longitudinal centerline of the jacket, thereby enhancing the uniformity of the density distribution of ball (disc) about the longitudinal centerline of the jacket, hence along the spin axis of the resulting projectile, hence enhanced spin stability of the projectile as it travels along its trajectory to a target.

BRIEF DESCRIPTION OF DRAWINGS

FIG. 4 is a representation of a core and a solid sphere loaded in a metal jacket preparatory to axial pressing of the core and sphere into the jacket;

FIG. 5 is a representation of a metal jacket having a core and a pressed sphere disposed therein and prior to the definition of an ogive at the open end of the jacket;

FIG. 6 is a representation of the definition of an ogive at the open end of the jacket depicted in FIG. 5; and, FIG. 7 is a representation of a projectile formed employing the method of the present invention;

FIG. 8 is a representation of a round of gun ammunition embodying a projectile as depicted in FIG. 7;

FIG. 9 is a cross-sectional view of a powder-based sphere useful in the projectile of the present invention;

DETAILED DESCRIPTION OF THE INVENTION

Figure 1:
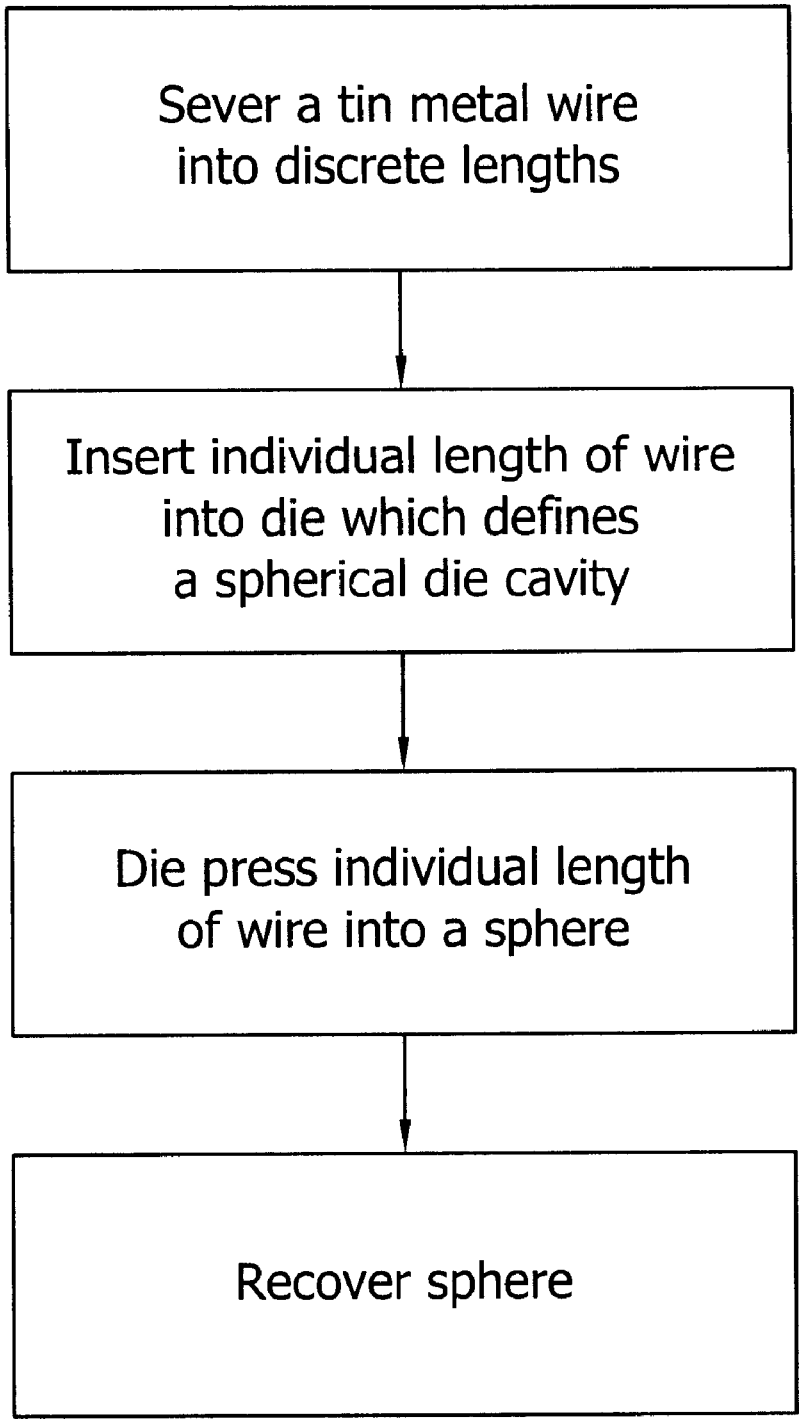
FIG. 1 is a schematic flow diagram depicting one embodiment of a method for forming a sphere for use in the present invention.
Figure 2:
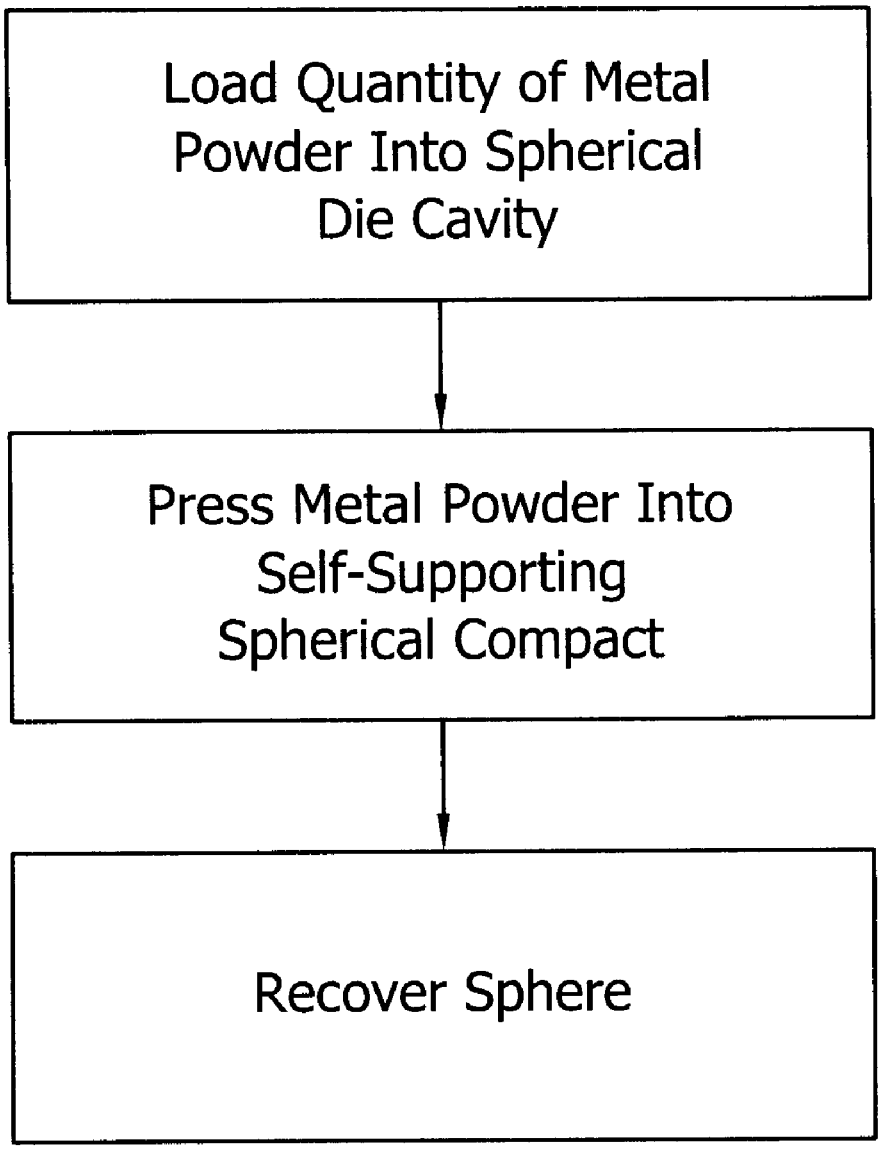
FIG. 2 is a schematic flow diagram depicting a further embodiment of a method for forming a sphere for use in the present invention.
Figure 3:
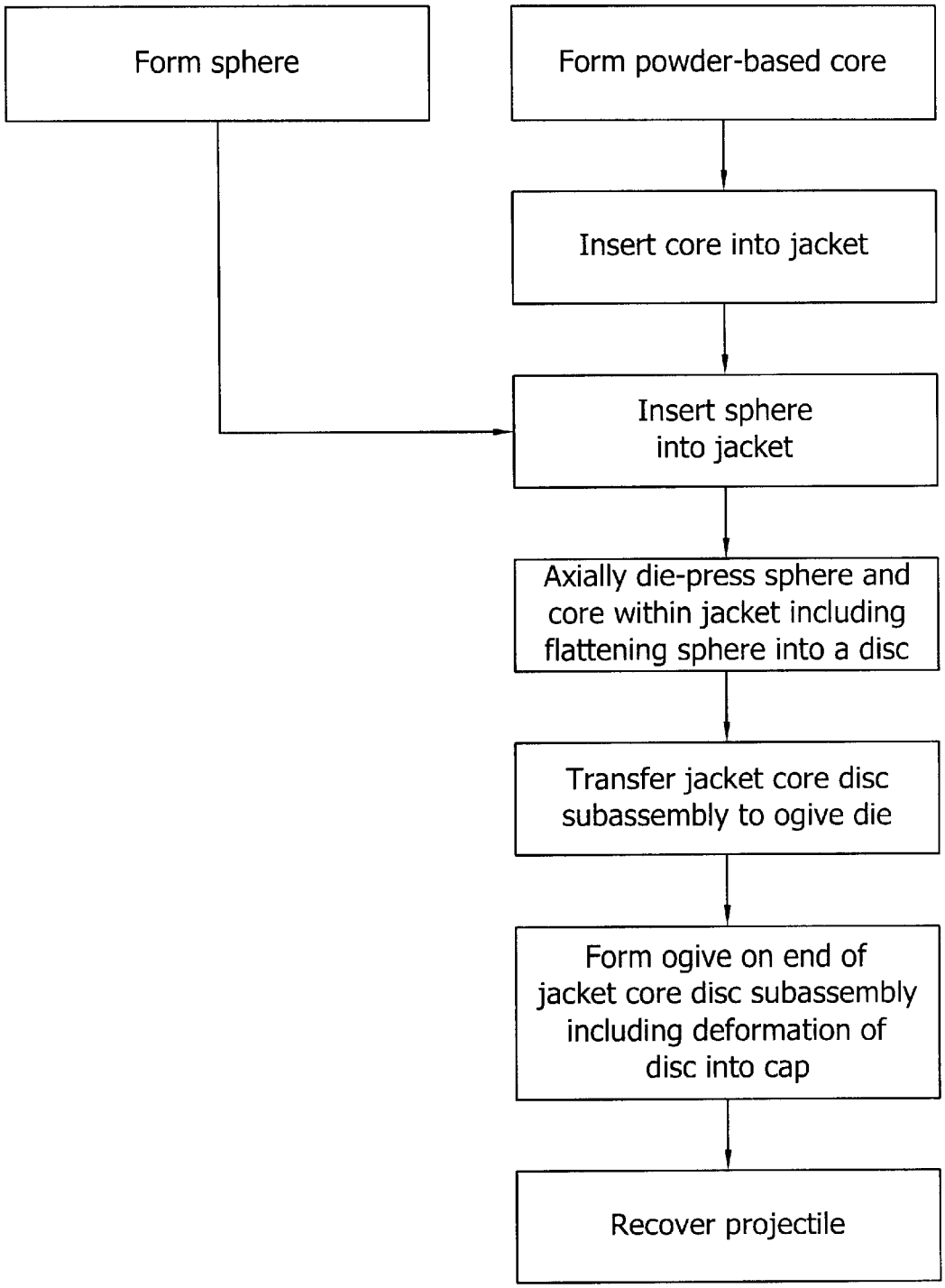
FIG. 3 is a schematic flow diagram of one embodiment of a method for forming a projectile in accordance with the present invention.
Figure 10:
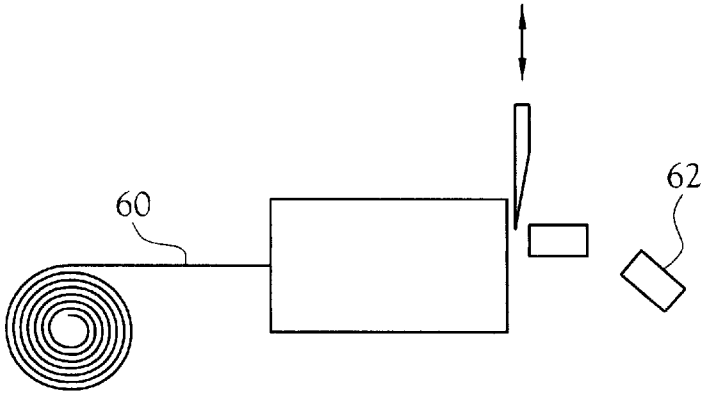
FIG. 10 is a schematic diagram of a process for the severing of a wire into individual segments preparatory to the formation of spheres from the segments.
Figure 11:
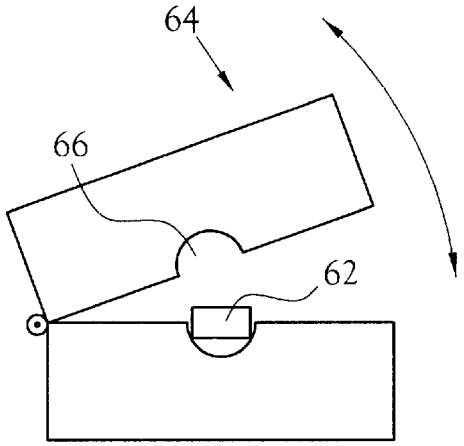
FIG. 11 is a schematic diagram of a bivalve die suitable for the forming of spheres from individual wire segments.

Referring initially to the several Figures, in accordance with one aspect of the present invention, the inventor has found that an improved seal for the initially open end 10 of a jacket 12 in the formation of a projectile 14, for use in a round of small-bore gun ammunition 16 (50 caliber or smaller), may be produced from a uniformly sized sphere 18, such as a solid sphere of a metal 20, such as tin metal, or a pressed compact 22 of metal powder particles, again such as tin metal powder. In either embodiment, the sphere 20,22 is of a uniform diameter and of uniform density distribution throughout. Thereafter, the sphere is inserted into a metallic jacket 54 having a closed end 26 and an open end 18 and which contains a powder-based core 30, the sphere being disposed most adjacent the open end 18 of the jacket relative to the core 30 or cores disposed within the jacket.

Referring specifically to FIGS. 4–7, with the core 30 and sphere-containing jacket 24 disposed in a supporting die 32, pressure is applied axially of the jacket directly against the sphere 20, hence indirectly against the core, as by means of a plunger 34 of a conventional die-pressing system. This action serves to seat the core 30 against the closed end 26 of the jacket and to partially flatten the sphere 20 into a disc 36 (see FIG. 5).

Thereafter, the open end 10 of the core- and disc-containing jacket is placed in the cavity 38 of a die 40 designed to define an ogive 42 on the leading (open) end 10 of the jacket 54. As this combination of jacket, core and disc is pressed into the ogive die, the open end 10 of the jacket, the distal (outward) end 46 of the powder-based core 30, and the disc 36 itself, are deformed to define the ogive. As seen in FIG. 7, the deformation of the disc in the ogive-forming die, forms the disc 36 into a hollow hemispherical geometry (i.e. a cap 70) which is wedged within the partially closed end of the jacket. Powder particles 50 from the core at least partially fill the hollow of the deformed disc.

Figure 12:
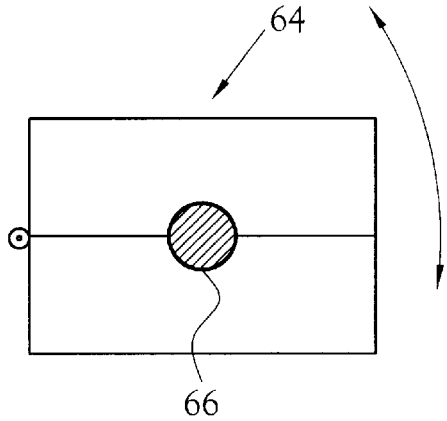
FIG. 12 is a further schematic diagram of the die of FIG. 11 in its closed state.
Figure 13:
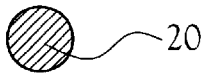
FIG. 13 is a cross-sectional view of a solid metal sphere formed employing the die depicted in FIG. 12.

With reference to FIG. 1, one embodiment of a solid metal sphere 20 useful in the present invention may be formed from a tin metal wire 60 which is severed into segments 62 of a length which is substantially equal to the diameter of the wire. Each segment is thereafter loaded into a split cavity die 64 which, when closed as in FIG. 12, defines a spherical cavity 66 having a diameter selected to provide a solid metal sphere 20 having a selected diameter for a given caliber of projectile. Within the die 64, the length of wire is die-pressed into a uniformly round sphere having a diameter which is about 0.002 inch smaller than the internal diameter of the jacket within which the sphere is to be loaded. The density distribution of the sphere radially outwardly from the center of the sphere, though it may vary from a first density adjacent the center of the sphere to a second density adjacent the circumferential periphery of the sphere, remains uniform in any given plane taken along a diameter of the sphere. This uniformity of density distribution is critical for successful implementation of the sphere in a projectile. Specifically, the present inventor has found that very small, even minute, deviations in the uniformity of distribution of the density in a direction radially of a sphere can essentially destroy the accuracy of delivery of the projectile to its target. This effect of the density distribution within the sphere can be readily understood when it is recognized that a gun projectile leaving the rifled barrel of a rifle having a seven twist is spinning about its longitudinal axis at several hundred thousand revolutions per minute. Spinning projectiles will travel more truly along their trajectory than non-spinning projectiles. However, if a projectile experiences nutation (wobble of the projectile about its own longitudinal centerline) along its trajectory, among other things, the projectile no longer follows its intended trajectory and it wanders and commonly misses its target. Even small, even minute, variations in the uniformity of the distribution of the density of a projectile, radially of and about its longitudinal centerline, encourages nutation of the fired spinning projectile. Thus, any non-uniformity of the distribution of the density of the sphere of the present invention is detrimental to the accuracy with which a projectile may be delivered to a target.

In one example, and referring to FIGS. 3–8, a sphere 20 of 0.1048 inch diameter formed in a split die 64 from a 0.1048 inch long segment 62 length of tin metal wire having a diameter of 0.1048 inch was inserted into a copper metal jacket 12 for a 0.223 cal. projectile, which previously had received a cylindrical die-pressed metal powder core 30 therein. The sphere, as initially positioned within the jacket rested in a concavity 52 in the outboard face of the cylindrical core. Thereupon, employing the plunger 34 inserted into the open end 10 of the jacket 12, the sphere 20 was flattened into substantially a disc 36 having a thickness of between about 0.020 inch and a diameter of 0.196 inch, overlying the outboard face 54 of the core 30. This action further caused the flattened sphere to spread laterally within the jacket to substantially close off (seal) the open (leading) end 10 of the jacket. Thereafter, the open (leading) end 10 of the jacket was disposed in a die cavity 38 designed to define a seven ogive 42 on the leading end of the projectile 14. This die-forming operation deformed the now disc-shaped sphere into a substantially hollow, general hemispherical, i.e. cup-shaped, body, i.e., cap, 70 within the jacket. Simultaneously a portion of the outboard (leading)

end of the cylindrical core 30 was caused to flow into the hollow concavity of the deformed cap, and both the cap and the powder particulates of the core were caused to substantially fill the ogive end of the jacket, leaving, in one embodiment, a relative small void, i.e. a meplat cavity 72, at the leading end of the projectile. In the present example, the meplat cavity was 0.1 inch in depth and about 0.062 inch in diameter at the open end of the projectile. In particular, the disc of the present invention was noted to yield uniformly as it was urged into the ogive geometry to define the cap, with no fracture thereof and no material deviation from uniform distribution of density radially from the longitudinal centerline 74 of the jacket, hence the spin axis of the projectile 14.

Other projectiles of 0.223 caliber (5.56 mm) of seven ogive were prepared in like manner and the same were fired from conventional law enforcement and military weapons such as the M16M4 military rifle having seven twist barrels. Firings were from weapons having barrel lengths of 10 inches, 14.5 inches and 20 inches. The jackets, cores, caps and the relative positions of the cores and caps were constant for all the fired projectiles. Specifically, the jackets were of copper metal and each of the cores was formed from a cold-pressed mixture of about 65% by wt. of tungsten metal powder and about 35% by wt. of tin metal powder, along with about 0.1% by wt. of a stabilizing non-metal powder, the total percentages of all powders equaling 100%. All the projectiles exhibited excellent spin stability and accuracies of about one minute of angle at 600 yards.

In the embodiment depicted in FIG. 4, the outboard face of the core 30 was provided with a dimple 52 (concavity) centrally of the face of the core and the sphere rested within this centrally disposed dimple preparatory to flattening of the sphere by the die plunger 34. Through the use of this concept of a central concavity in the face of the core, the sphere is "automatically" centered with the jacket. By this means, the process of transferring a single sphere into a core-containing jacket is readily and efficiently accomplished employing automated machinery. Moreover, the formation of solid spheres of uniform diameter and density distribution may be carried out using conventional automated machinery. Such automation represents substantial savings in manufacturing costs as compared to the manufacture and handling of discs for use in ammunition projectiles.

It will be noted in FIGS. 5 and 6 that the axial pressing of the sphere 20 flattens the sphere into a generally disc-geometry, but with a central convex projection 76 on that surface of the disc facing the core. In the course of forming the ogive on the jacket-core-disc combination, the disc is converted into a generally cup-shaped cap 70 and the convex projection becomes disposed within the hollow of the cap, along with powder from the core.

Projectiles were prepared using spheres of 0.1731, 0.120 and 0.1048 inch diameters, which yielded flattened discs of 0.090 inch, 0.030 and 0.020 inch thicknesses, respectively, each having a diameter of 0.196 inch. These projectiles were fired from the same weapon. Notably it was found that projectiles prepared with a 0.090 inch thick disc, at 100 yards, would not penetrate AR500 armor plate, whereas like projectiles prepared with 0.030 inch or 0.020 inch thick disc would penetrate the same armor plate at 100 yards, an unexpected result. Accordingly, depending upon the desired ballistics coefficient for a given projectile, different diameter spheres, hence different resulting thicknesses of the disc may be employed to obtain such desired results.

The tin metal wire employed in the present examples was in a substantially non-oxidized state, however, oxidation of the tin was not as significant as when working with tin metal powder which must be die-pressed into a self-supporting compact. Other metals such as zinc, iron, aluminum or mixtures of these or similar relatively light-weight metal powders, including alloys thereof, may be employed in the manufacture of the sphere of the present invention, either as a solid metal sphere or as a spherical pressed metal powder compact. Moreover, the sphere may comprise a polymeric material which is reformable under pressure to be initially formed into a sphere, subsequently substantially flattened, and ultimately convertible into a cup-shaped cap, and is of uniformly distributed density.

Among the advantages of the sphere of the present invention is the ease with which the wire segments may be prepared, the ease of mechanically handling the transfer of wire segments into and away from a sphere-forming operation, and the ease with which the sphere may be transferred by mechanical (automatic) means into the jacket. Moreover, the present sphere concept eliminates the difficult and expensive process of rolling tin metal into uniformly thick sheets for stamping out solid metal discs, as well as elimination of flashing associated with die-stamping discs from a metal sheet.

Whereas the present method has been described in specific terms and using specific examples, it is intended that the invention be limited only as set forth in the claims appended hereto.

What is claimed:

1. A method of manufacturing a gun ammunition multi-component projectile including at least one powder-based core disposed within a jacket of generally cup-shape having a closed end and an open end and a longitudinal centerline comprising the steps of providing a spherical member of either a solid metal or a self-supporting pressed compact of at least one metal powder, disposing said spherical member within the jacket and between the core and the open end of the jacket, with the jacket/core/spherical member combination disposed within a first die cavity, applying sufficient pressure to said spherical member in a direction axially along the longitudinal centerline of the jacket to deform said spherical member into a generally flat disc which extends radially across the cross-sectional area of the jacket adjacent the core, disposing said pressed jacket/core/disc combination in a second die cavity suitable for at least partial closing of the open end of the jacket and formation of an ogive on said at least partially closed end of the jacket, including deformation of said disc into a generally hollow hemispherical geometry and disposed in sealing relationship to the at least partially closed end of the jacket, at least a portion f said at least one powder-based core substantially filling said generally hollow hemispherical deformed disc.

2. The method of claim 1 wherein said spherical member comprises a solid metal ball.

3. The method of claim 1 wherein said spherical member comprises a spherical compact formed from a quantity of pressed metal powder.

4. The method of claim 1 wherein said spherical member comprises tin, zinc, copper, iron, magnesium, aluminum, or a mixture or an alloy of two or more of said metals.

5. The method claim 4 wherein each of said metals is in its powdered form.

6. The method of claim 1 wherein said step of providing a spherical member includes compressing a quantity of metal powder particles into a self-supporting spherical member preparatory to disposition of said spherical member within the jacket.

7. The method of claim 1 wherein said core is of generally straight cylindrical geometry and includes a substantially flat face disposed adjacent the open end of the jacket, and including the step of forming a concavity centrally disposed of the flat face of the core.

8. The method of claim 7 and including the step of disposing said spherical member within said concavity preparatory to the application of pressure against said spherical member.

9. The method of claim 1 wherein the diameter of said spherical member is about 0.002 inch less in diameter than the internal diameter of the jacket at its open end.

* * * * *